US005103666A

United States Patent [19]

Schroeder

[11] Patent Number: 5,103,666

[45] Date of Patent: Apr. 14, 1992

[54] APPARATUS AND METHOD OF STRAIGHTENING THE ENDS OF ELONGATED WORKPIECES

[75] Inventor: Hermann Schroeder, Düsseldorf, Fed. Rep. of Germany

[73] Assignee: Mannesmann Aktiengesellschaft, Dusseldorf, Fed. Rep. of Germany

[21] Appl. No.: 643,908

[22] Filed: Jan. 18, 1991

[30] Foreign Application Priority Data

Jan. 19, 1990 [DE] Fed. Rep. of Germany ..... 4001901

[51] Int. Cl.[5] ..... B21D 3/10

[52] U.S. Cl. ..... 72/403; 72/306; 72/316; 72/369

[58] Field of Search ..... 72/403, 399, 316, 306, 72/406, 389, 383, 381, 160, 408, 369

[56] References Cited

U.S. PATENT DOCUMENTS

| | | | |
|---|---|---|---|
| 455,905 | 7/1891 | Thomson | 72/403 |
| 3,114,276 | 12/1963 | Uebing | 72/406 |
| 3,713,312 | 1/1973 | Galdabini | 72/389 |
| 3,717,020 | 2/1973 | Judge | 72/389 |
| 4,488,423 | 12/1984 | Newell | 72/160 |

FOREIGN PATENT DOCUMENTS

| | | | |
|---|---|---|---|
| 732047 | 5/1980 | U.S.S.R. | 72/160 |
| 112661 | 1/1918 | United Kingdom | 72/160 |

*Primary Examiner*—Daniel C. Crane

*Attorney, Agent, or Firm*—Cohen, Pontani, Lieberman & Pavane

[57] ABSTRACT

An apparatus for straightening the end of an elongated workpiece which has a longitudinal axis and an elastic limit includes at least three rams arranged symmetrically around the workpiece and around a common axis and are moveable perpendicularly to the axis for deflecting the longitudinal axis of the workpiece into a path of revolution by deforming the workpiece beyond the elastic limit without rotating the workpiece around the axis. A piston cylinder unit is connected to each of the rams for performing a reciprocal stroke movement. The piston cylinder units are selectively controlled so that the piston cylinder units and associated rams perform a phase shifted sinusoidal stroke movement. The method is performed by centering the workpiece between at least three load applying members disposed radially and symmetrically about the workpiece so that the longitudinal axis is at a locus, deflecting the longitudinal axis of the workpiece away from the locus by applying a load to the workpiece with at least one of the load applying members in a predetermined amount perpendicular to the axis and beyond the elastic limit of the workpiece, acting with the load applying members on the workpiece so that the deflected axis describes a path of revolution around the locus without rotating the workpiece, and maintaining the predetermined deflection over at least one revolution.

12 Claims, 3 Drawing Sheets

APPARATUS AND METHOD OF STRAIGHTENING THE ENDS OF ELONGATED WORKPIECES

FIELD OF THE INVENTION

The present invention relates to an apparatus and method for the straightening of the end of an elongated workpiece, and particularly to a method and apparatus wherein the workpiece is straightened without rotating the same.

BACKGROUND AND SUMMARY OF THE INVENTION

Elongated workpieces, for instance, bars or tubes having impermissible deviations in linearity, are customarily straightened in the course of manufacture by means of a continuously operating straightening machine, for instance, a roll straightener. However, the deflected ends to the workpieces are only partially, if at all, subject of this straightening process. In workpieces having cross sections at their ends which are different from the rest of the workpiece, as in, for instance, bulged or upset pipe ends, the previously known continuous method fails entirely. For this reason, such workpieces, which in accordance with their specifications or due to the requirements of the further processing are desired to have only limited deviation in linearity, are, therefore, subsequently straightened manually by means of gag presses. This method is expensive and requires a suitably trained operator having an accurate measuring eye. Furthermore, for the turning of the workpiece which is necessary during the straightening process, there must be present a suitable apparatus for handling the individual pieces, some of which are heavy, namely either a crane, hoist or the like.

From the Federal Republic of Germany 1901184, an apparatus is known for the dynamic balancing of workpieces which includes a driven crankshaft of adjustable eccentricity which is firmly connected via a crank arm to the workpiece. The workpiece is firmly supported at its ends and the axis of the workpiece is rotatingly deflected beyond the elastic limit of the workpiece at the place of clamping of the crank arm. The rotating deflection takes place in this connection without rotation of the workpiece around its own axis.

This apparatus has a disadvantage of the disproportionally high structural expense for varying the eccentricity of the crankshaft. Furthermore, the apparatus is not suitable for straightening the ends of elongated workpieces.

An object of the present invention is thus to provide a structurally simple apparatus with which the ends of elongated workpieces can be effectively straightened.

This object is achieved by providing an apparatus for straightening the end of an elongated workpiece having a longitudinal axis at a locus and an elastic limit, comprising means arranged symmetrically about the workpiece for deflecting the longitudinal axis of the workpiece for a predetermined amount and along a path of revolution around the locus without rotating the workpiece around the axis, the means comprising at least three load applying members arranged symmetrically around a common axis for selectively applying a predetermined load to the workpiece by moving perpendicular to the axis; actuator means connected to each load applying member for imparting load applying movement to the workpiece; and means connecting the actuator means for selectively controlling each actuator means so as to impart to the load applying members a phase shifted sinusoidal stroke movement. The movement of the load applying members is controlled responsive to time and path of the movement so that it results in a sinusoidal stroke movement.

The method according to the present invention comprises centering the workpiece between at least three load applying members which are disposed radially and symmetrically about the workpiece so that the longitudinal axis of the workpiece is positioned at a certain location. Thereafter, the longitudinal axis of the workpiece is deflected away from that location by applying a load with at least one of the load applying members in a predetermined amount and perpendicular to the axis and beyond the elastic limit of the workpiece. The load applying members of the apparatus are then controlled so that the deflected axis of the workpiece describes an imaginary path of revolution around the original location of the axis. In other words, the axis of the workpiece is deflected from an original first position or location, for a predetermined amount, to a second location. The workpiece is then acted upon by the load applying members in a manner so that the imaginary point of the second location describes a revolution about the first location of the axis of the workpiece. The predetermined maximum deflection is maintained over at least one revolution.

In the method of the invention, and with the workpiece kept stationary, at least one desired cross section of the workpiece in the region of the ends thereof is subjected to an increasing and decreasing alternate bending stress. In this operation the bending stress is selected so that the desired cross section of the workpiece is deformed up into the plastic region. A characteristic feature of the method of the present invention is that the maximum deflection resulting from the bending stress, which can be determined in advance as a function of the material used, moves one or more times around the axis of the workpiece. The straightening process itself can take place in various manners, depending on whether the maximum deflection is applied rapidly within a short time or only gradually. In the former case, after a centering of the workpiece, it is suddenly acted on so that the maximum amount of deflection is reached. This maximum point of deflection is then rotated one or more times around the original location of the axis of the workpiece. This is followed by a sudden release from the load. In the second case, the workpiece after the centering thereof, is acted on by a load to reach a given deflection which then rotates in the manner described, while the bending stress is continuously increased during the rotating of the deflection until the maximum deflection is reached. The latter is then maintained over a given path of rotation followed by continuous reduction in the bending stress until complete release of the workpiece from the load. The method of the present invention can be applied both to cold and heated workpieces.

The apparatus includes at least three and preferably four load applying members such as rams arranged symmetrically around a common axis, each of the rams being connected to a separate actuator such as a piston-cylinder unit. The piston and cylinder units are controllable with respect to path and time so that during the straightening process the respective pistons carry out a sinusoidal movement with respect to time. The controls of the piston-cylinder units are connected with each other so that they can operate out of phase with each other.

The advantage of the apparatus and method of the present invention resides in the fact that the workpiece is stationary during the straightening process and no rotating tool of expensive design is required. The method can be carried out automatically and can easily be integrated in a by-pass of a manufacturing line. By the use of suitably dimensioned hydraulic cylinders, the apparatus can be rapidly and easily adjusted without conversion to different dimensions of the workpiece. The desired maximum deflection can be selected freely, depending on the material used.

BRIEF DESCRIPTION OF THE DRAWINGS

The method and the apparatus of the present invention are explained in further detail in the drawings, in which.

DETAILED DESCRIPTION OF THE PRESENTLY PREFERRED EMBODIMENT

Figure 1:
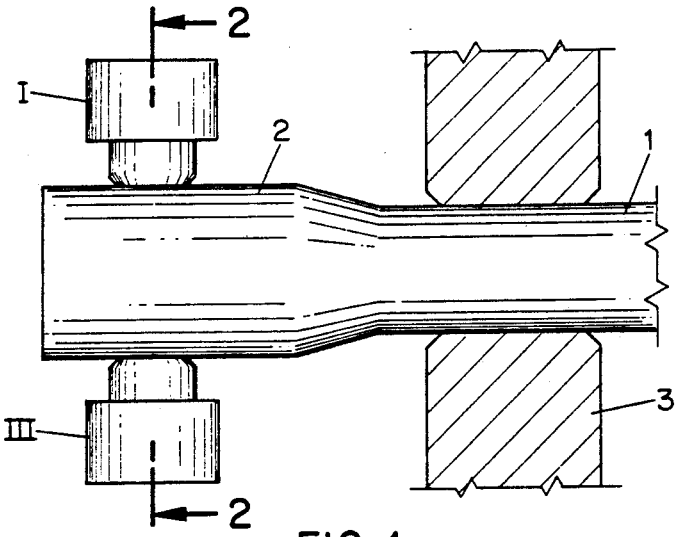
FIG. 1 is a longitudinal sectional view through the apparatus of the present invention.
Figure 2:
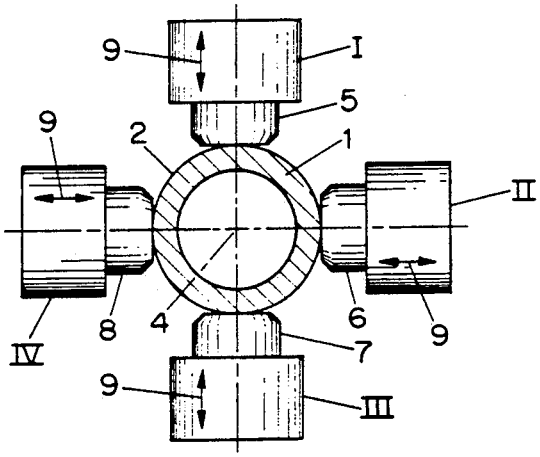
FIG. 2 is a cross sectional view along the line A—A of FIG. 1.
Figure 4A:
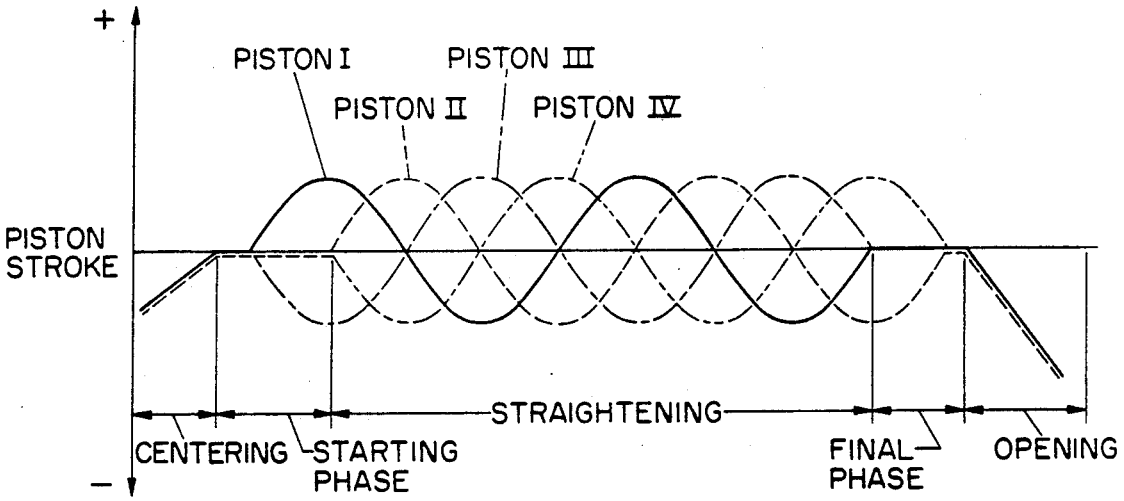
FIG. 4A is a graph showing an entire straightening process.

FIG. 1 shows the apparatus of the present invention in simplified form in a longitudinal section, the accessory parts customarily forming a part hereof not being shown. The pipe 1, which is clamped in a holding member 3 (not shown in detail) has a bulged or upset end 2, the linearity of which is not in accord with the delivery specification and, therefore, is to be straightened. For this purpose, as shown in FIG. 2, four rams 5,6,7,8 are arranged symmetrically around a common axis 4 around the bulged end 2 of the pipe 1. Each of the rams 5–8 is connected with a separate piston-cylinder unit, indicated here with the roman numerals I to IV corresponding to the graphical representation of the straightening process in FIG. 4A. The radial displaceability of the rams 5 to 8 is in each case indicated by the arrows 9.

Figure 3:
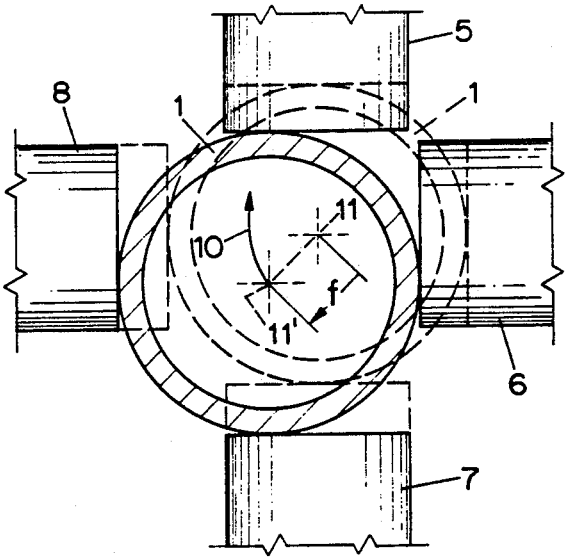
FIG. 3 is a diagrammatic view of the maximum deflection f.
Figure 4B:
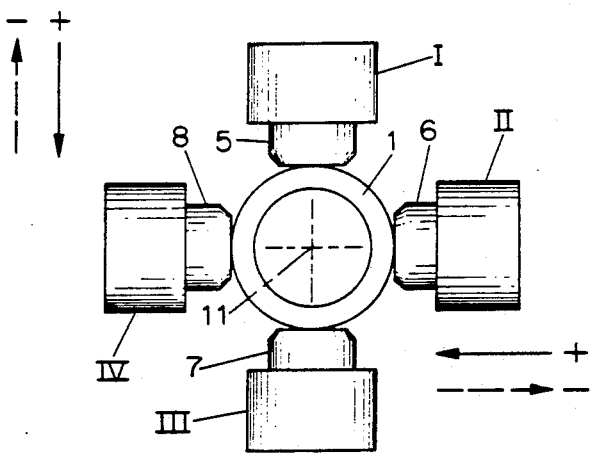
FIG. 4B is the view of FIG. 2 with indication of stroke.

FIG. 3 shows diagrammatically the rotating maximum deflection f. The curved arrow 10 indicates the rotation or revolution of the deflection f. The position of the rams 5–8, shown in dashed line, indicates the starting point of the pipe 1 after the centering. The displacement of the center point 11 to 11' characterizes, for this example, the maximum deflection f which, calculated form the 6 o'clock position, has already passed through an angle of 45°. This revolution 10 is produced by the straightening process shown graphically in FIG. 4A. In the graph, the stroke of the piston of the corresponding piston-cylinder unit I to IV is plotted on the coordinate axis. This stroke corresponds to the radial path of travel of the corresponding ram 5 to 8. As indicated by the arrows (FIG. 4B), a positive amount indicates movement of the piston or ram towards the center 11 and the negative amount in the reverse direction.

The first phase of the straightening process, namely the centering, comprises the movement of all pistons I to IV in the direction towards the center 11. After this, the starting phase commences, i.e. the piston I moves in the direction towards the center 11 and, corresponding to this, the opposite piston III moves away from the center. As soon as the piston I has reached the maximum of the sinusoidal course of the stroke, the pipe 1 also has the predetermined maximum deflection f. From here on, the actual straightening commences in the manner that the maximum deflection f revolves in clockwise or counterclockwise direction. This is obtained in the manner that, shifted in phase from the piston I, the stroke of the piston II and, corresponding to this in an opposite direction, the stroke of the piston IV commences. After a single or, as in this example, two revolutions, the stroke movement drops in the final phase to zero and by the subsequent opening of all four pistons I to IV, i.e. movement away from the center 11, the straightened end 2 of the pipe 1 is freed.

Figure 5A:
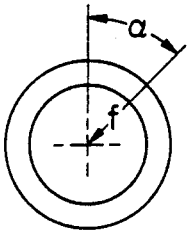
FIG. 5A is a cross-sectional view of a pipe showing graphically the deflection f and angle of revolution $\alpha$.
Figure 5B:
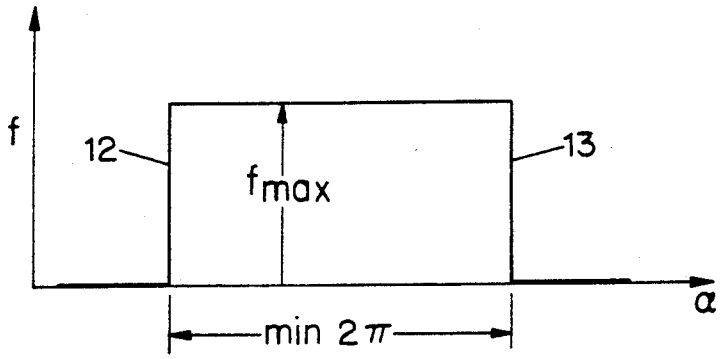
FIG. 5B is a graph showing one application of maximum deflection f in relation to revolution.
Figure 5C:
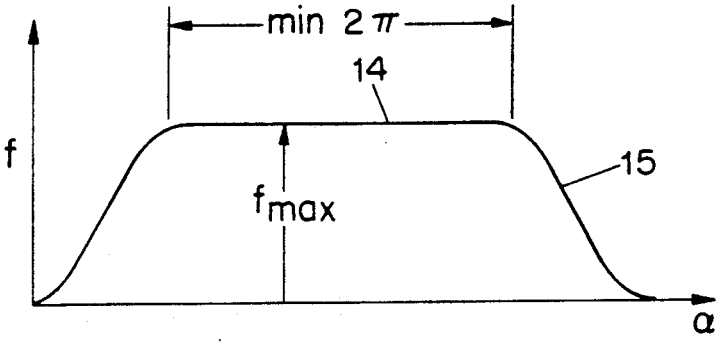
FIG. 5C is a graph showing yet another application of maximum deflection f in relation to revolution.

In FIG. 5 there are graphically shown as a supplement to FIG. 4, two different courses of the maximum deflection f. In FIG. 5A, the two determining parameters, i.e. the deflection f and the angle of revolution alpha are entered, for instance, for a pipe. FIG. 5B shows the variant in which the maximum deflection f is applied in a very brief time, i.e. with a very steep rise 12, and the rotation or revolution already described then takes place. At the end of the rotation there is the steep drop 13 until the pipe 1 is completely relieved of the load. Contrary to this, in the variant shown in FIG. 5C, the rotation commences immediately upon the application of the initial deflection f, this deflection increasing continuously upon further rotation to the maximum value 14. This maximum value 14, in a manner comparable to that already shown in FIG. 5B, is maintained for at least one full revolution. After that, there takes place the slowly controlled drop 15 until complete relief of the pipe 1 from the load occurs.

Figure 6:
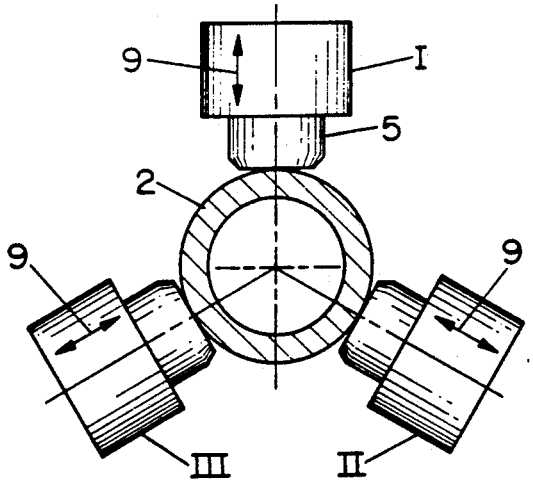
FIG. 6 depicts an alternate embodiment utilizing three rams to impart the necessary deflection and rotation upon the workpiece to be straightened.

FIG. 6 shows an alternate embodiment of the apparatus of the present invention configured with only three rams, indicated as I, II and III. In this embodiment, the three rams are symmetrically disposed around the workpiece, as previously described, and the function is the same as previously described, however instead of there being four rams positioned 90° apart, in a three ram embodiment the three rams are positioned 120° apart.

It should be understood that the preferred embodiments and examples described are for illustrative purposes only and are not to be construed as limiting the scope of the present invention which is properly delineated only in the appended claims.

What is claimed is:

1. An apparatus for straightening the end of an elongated workpiece having a longitudinal axis and an elastic limit, comprising:

means for nonrotatively holding said workpiece within said apparatus;

means for deflecting said longitudinal axis of said workpiece into a path of revolution by deforming said workpiece beyond said elastic limit, said means comprising at least three rams, each of said rams being adjacently arranged radially and in symmetrically spaced apart relation around said workpiece so as to define an equal degree of separation between each ram and an adjacent ram;

a piston-cylinder unit connected to each of said rams for imparting a reciprocal stroke movement thereto in a direction perpendicular to said longitudinal axis of said workpiece; and means connecting said piston-cylinder units for selectively controlling said movement of said piston-cylinder units so as to impart a sinusoidal stroke movement to each of said rams, said sinusoidal stroke movement of each of said rams being phase shifted relative to the sinusoidal stroke movement of an adjacent ram by an amount equal to the degree of separation between each of said rams.

2. The apparatus according to claim 1, wherein said movement of said piston-cylinder units is controlled responsive to time and path of said movement.

3. The apparatus according to claim 1, comprising a first and second pair of rams oppositely and symmetrically arranged about said common axis and said workpiece; and wherein said sinusoidal movement of said second pair of rams is phase shifted relative to said sinusoidal movement of said first pair of rams.

4. An apparatus for straightening the end of an elongated workpiece having a longitudinal axis at a locus and an elastic limit, comprising:

means for nonrotatively holding said workpiece within said apparatus;

means arranged about said workpiece for deflecting said longitudinal axis of said workpiece for a predetermined amount and along a path of revolution around said locus without rotating said workpiece around said axis, said means comprising at least three load applying members symmetrically arranged around a common axis for selectively applying a predetermined load to said workpiece, by moving perpendicularly to said axis;

actuator means connected to each said load applying member for imparting said load applying movement to said workpiece; and means connecting said actuator means for selectively controlling each said actuator means so as to impart to said load applying members a phase shifted sinusoidal stroke movement.

5. The apparatus of claim 4, wherein the movement of said load applying members is controlled responsive to time and path of said movement.

6. A method of straightening the end of an elongated workpiece having a longitudinal axis, comprising:

holding said workpiece to prevent rotation around said longitudinal axis;

centering said workpiece between at least three load applying members adjacently disposed radially and fixed in symmetrically spaced apart relation about said workpiece so that said longitudinal axis is positioned at a locus and so that an equal degree of separation is defined between each load applying member and an adjacent load applying member;

independently controlling the load applied by each of said radially disposed load applying members to said workpiece so as to deflect said longitudinal axis of said workpiece away from said locus by a predetermined amount and in a direction perpendicular to said axis and beyond the elastic limit of said workpiece;

acting simultaneously with each of said load applying members at radially symmetrical fixed points on said workpiece so that said deflected axis describes a path of revolution around said locus without rotating said workpiece; and maintaining said predetermined deflection over at least one revolution.

7. The method according to claim 6, wherein said deflection of said axis is obtained prior to revolving said deflected axis; said deflection is maintained during at least one revolution; said revolving is ceased; and, thereafter, said load is withdrawn.

8. The method according to claim 7, wherein said deflection of said axis and said withdrawal of said load are performed suddenly.

9. The method according to claim 7, wherein said deflection of said axis and said withdrawal of said load are performed in less than 5 seconds.

10. The method according to claim 7, wherein said deflection of said axis and said withdrawal of said load are performed in less than 3 seconds.

11. The method according to claim 7, wherein said deflection of said axis and said withdrawal of said load are performed in less than 1 second.

12. The method according to claim 6, wherein said deflection of said longitudinal axis of said workpiece and said revolving of said deflected axis around said locus are performed concurrently and by continuously increasing said deflection to reach a predetermined maximum deflection; said maximum deflection is maintained for at least one revolution; and said deflection is gradually released during said revolving.

* * * * *